US006203230B1

(12) United States Patent
Whang

(10) Patent No.: US 6,203,230 B1
(45) Date of Patent: Mar. 20, 2001

(54) PROTECTIVE NOTEBOOK

(75) Inventor: Yoon S. Whang, Newport Beach, CA (US)

(73) Assignee: Avalanche Publishing, Inc., Huntington Beach, CA (US)

( * ) Notice: Subject to any disclaimer, the term of this patent is extended or adjusted under 35 U.S.C. 154(b) by 0 days.

(21) Appl. No.: 09/521,517

(22) Filed: Mar. 8, 2000

(51) Int. Cl.[7] ..... B42F 13/00

(52) U.S. Cl. ..... 402/57; 402/503; 402/4; 281/27.3; 281/51; 281/29

(58) Field of Search ..... 281/15.1, 21.1, 281/28, 27.2, 27.3, 29, 36, 37, 39, 45, 51; 402/503, 57, 4

(56) References Cited

U.S. PATENT DOCUMENTS 5,979,942 * 11/1999 Ivicic ..... 281/29

* cited by examiner

*Primary Examiner*—Willmon Fridie, Jr.
(74) *Attorney, Agent, or Firm*—DiPinto & Shimokaji, P.C.

(57) ABSTRACT

A notebook includes a first cover comprised of a first metallic material and having a plurality of first edges. A second cover is comprised of a second metallic material, with the second cover having a plurality of second edges and interfacing the first cover. A binding binds together one of the first edges to one of the second edges. A first lip element extends substantially perpendicular from a first plane of the first cover, with the first lip element comprised of a third metallic material and interfacing a paper edge of a paper at a substantially perpendicular angle. A second lip element extends substantially perpendicular from a second plane of the second cover, with the second lip element comprised of a fourth metallic material and interfacing the paper edge at a substantially perpendicular angle. Thereby, the first and second lip elements prevent damage to the paper edge in the absence of means disposed between the first and second lip elements for juxtaposing the first lip element to the second lip element.

23 Claims, 3 Drawing Sheets

FIG. 4
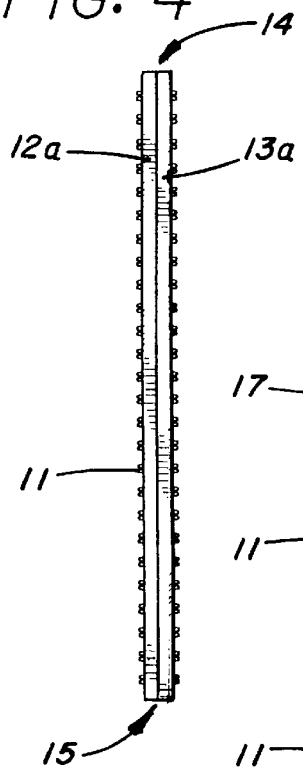
FIG. 2
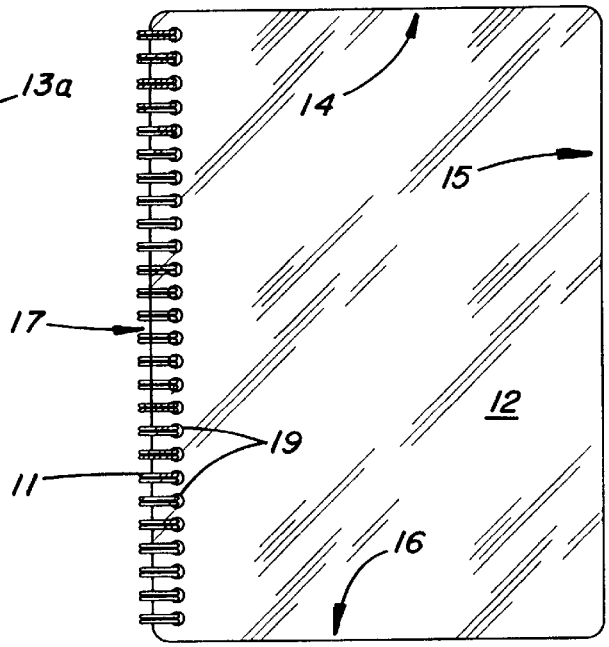
FIG. 5
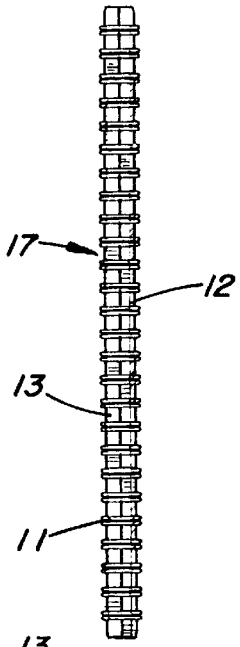
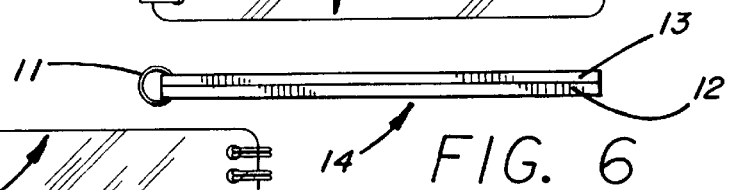
FIG. 6
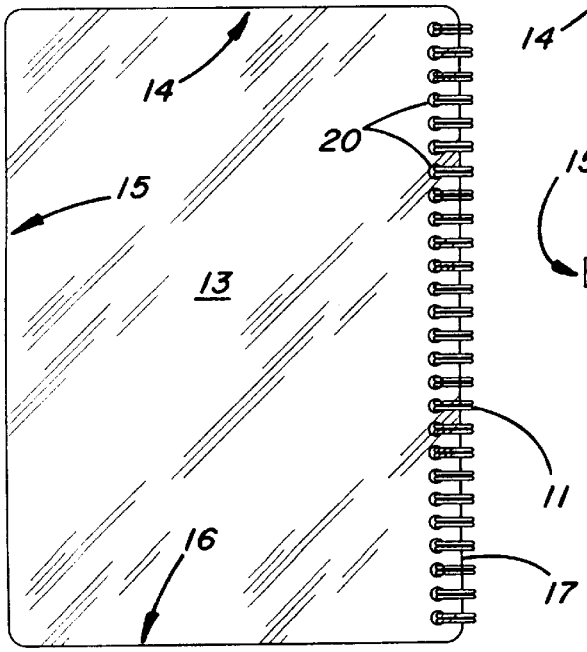
FIG. 3
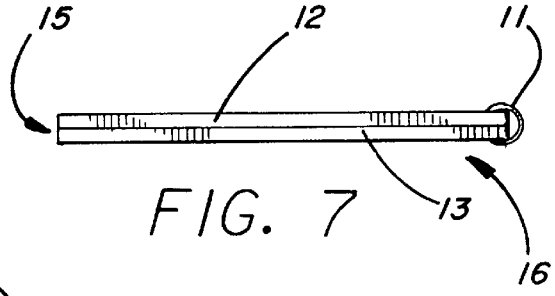
FIG. 7

PROTECTIVE NOTEBOOK

BACKGROUND OF THE INVENTION

1. Field of the Invention

The present invention generally relates to notebooks and, more particularly, to notebooks that protect the paper therein, including the edges of the paper.

2. Description of Related Art

Notebooks used to hold sheets of paper have been numerous. In general, they have been used cover the writing area of paper to primarily protect the writings. Accordingly, covers on notebooks have typically been configured and dimensioned to match the writing area. Many notebook covers have been constructed with paper materials to add further protection to the sheets of writing paper. However, the paper materials are substantially flexible and, thus, leave the writing paper susceptible to damage, such as from impact.

In a somewhat related fashion, covers made of metal have been used to protect books. For example, U.S. Pat. No. 718,827 discloses metal covers that are affixed to a book by metal fasteners. The metal fasteners pass through the metal covers and book covers themselves. The fasteners include claws which are bent open upon the inside of the book covers. The edges of the metal covers are turned inwardly to protect the edges of the book covers. However, the manner of attaching the covers makes replacement difficult. Also, the edges of the pages of the book are left unprotected.

U.S. Pat. No. 959,284 also discloses a metallic book cover. The covers are hinged together at the spine of the book. The covers include tongue portions at the spine and which bent back to form loops. A back piece extends along the spine of the book and provides tongues bent back to form loops. With the loops, pins extend through the loops to form a hinge joint. The edges of the covers are crimped onto pieces of cardboard positioned between the covers and book. Disadvantages to this design include the fact of it being somewhat complex and, therefore not easily manufactured at a low cost. In addition, the edges of the pages of the book are left unprotected.

The metal book binding shown in U.S. Pat. No. 3,938,831 includes a metal cover for the front book cover, another metal cover for the back book cover, and a third metal cover for the book spine. The metal cover for the spine is attached to the other metal covers by metal mesh. The metal covers for the front and back book covers are wrapped around the edges of the book covers opposite the spine. Thereby, normal hinge action of the book is left unencumbered. Yet, edges of the book covers remain unprotected, as do the edges of the pages.

A spiral bound book is described in U.S. Pat. No. 5,709,409. Magnets and/or weights are placed inside the covers. The magnet in one cover allows such cover to be affixed to a magnetic surface while the other cover having a weight allows the book to be in an open position. While the magnets/weights provide a means to keep the book in an open position, they provide little, if any protection to the book covers or pages.

As can be seen, there is a need for a notebook that is simple in design yet provides protection to the sheets of paper therein. A notebook is needed that provides protection for more than just the writing area of pages in the notebook. Also needed is a notebook that protects the pages from impact damage and the like. A further need is for a notebook that not only generally protects the sheets of paper therein, but also specifically all of the edges of the sheets of paper.

SUMMARY OF THE INVENTION

The present invention is directed to an improved notebook that generally protects the sheets of paper therein by covers that are made of rigid or substantially impact resistant materials. A binding, such as a spiral wire, binds the sheets of paper between the covers while providing protection to the edges of the papers adjacent the binding. A protective element or lip extends about the edge of both covers such that the edges of the papers are protected.

Specifically, the improved notebook includes a first cover comprised of a first metallic material and having a plurality of first edges. A second cover is comprised of a second metallic material, with the second cover having a plurality of second edges and interfacing the first cover. A binding binds together one of the first edges to one of the second edges. A first lip element extends substantially perpendicular from a first plane of the first cover, with the first lip element comprised of a third metallic material and interfacing a paper edge of a paper at a substantially perpendicular angle. A second lip element extends substantially perpendicular from a second plane of the second cover, with the second lip element comprised of a fourth metallic material and interfacing the paper edge at a substantially perpendicular angle. Thereby, the first and second lip elements prevent damage to the paper edge in the absence of means disposed between the first and second lip elements for juxtaposing the first lip element to the second lip element.

These and other features, aspects and advantages of the present invention will become better understood with reference to the following drawings, description, and claims.

BRIEF DESCRIPTION OF THE DRAWINGS

FIG. 2 is a plan view of a front cover of the notebook shown in FIG. 1;

FIG. 3 is a plan view of a rear cover of the notebook shown in FIG. 1;

FIG. 4 is a side view of a side of the notebook shown in FIG. 1 that opens for access;

FIG. 5 is a side view of another side of the notebook shown in FIG. 1 that allows a hinged opening of the notebook;

FIG. 6 is a top view of the notebook shown in FIG. 1;

FIG. 7 is a bottom view of the notebook shown in FIG. 1; and

DESCRIPTION OF THE PREFERRED EMBODIMENTS

Figure 1:
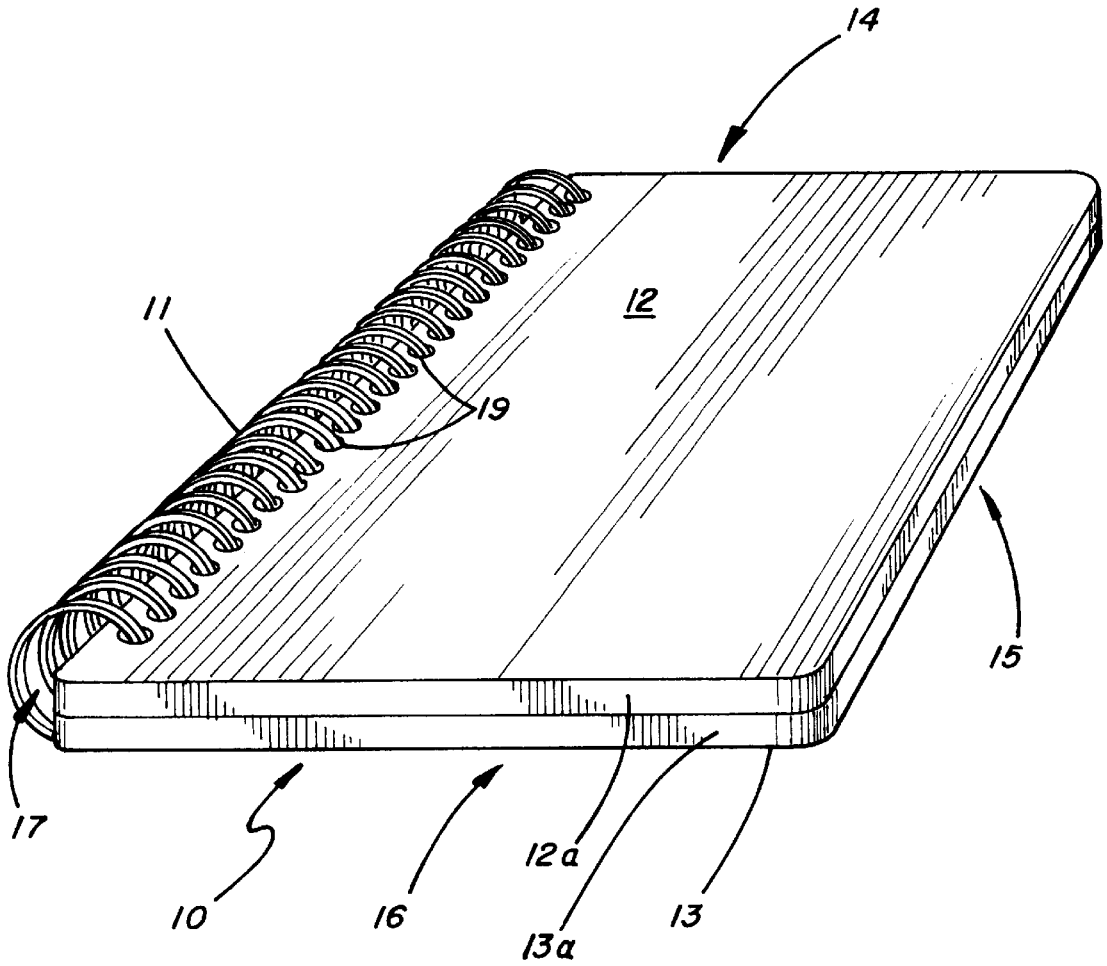
FIG. 1 is a perspective view of a notebook in a closed position according to an embodiment of the present invention.

The present invention is described below in the context of a "notebook." The reference to "notebook" is intended to refer to covers that sandwich therebetween sheets of paper that allow writing on them and/or have pre-printed writing on them. The former may be generally referred to as a notepad and the latter a book. Nevertheless, the present invention is not so limited. For example, the "notebook" may allow for the mounting of pictures on the sheets of paper. Additionally, while the notebook is shown in the drawings hereto with a rectangular configuration, other configurations can be used to accommodate to shape of the paper being used. Thus, if the paper is octagon in shape, as an example, the overall shape of the notebook, including its covers, may be octagonal.

In FIG. 1, a notebook 10 according to one embodiment of the present invention is shown. The notebook 10 includes a first or top cover 12 (FIG. 2) that interfaces or is juxtaposed to a second or bottom cover 13 (FIG. 3). The first cover 12 has a substantially planar configuration. It is preferably constructed of a first rigid or impact resistant material, such as a plastic or metal, so that the cover 12 is prevented from bending or otherwise changing its shape to such an extent that paper within the notebook 10 is damaged. A metal material is more preferable since it tends to be more impact resistant and, thus, affords more protection to sheets of paper, as described below. Likewise, the second cover 13 has a substantially planar configuration. It too is made of a second rigid or impact resistant material, such as a plastic or metal, so that the cover 13 is prevented from bending or otherwise changing its shape to such an extent that paper within the notebook 10 is damaged. The second rigid material may or may not be made of the same material as the first rigid material.

Figure 8:
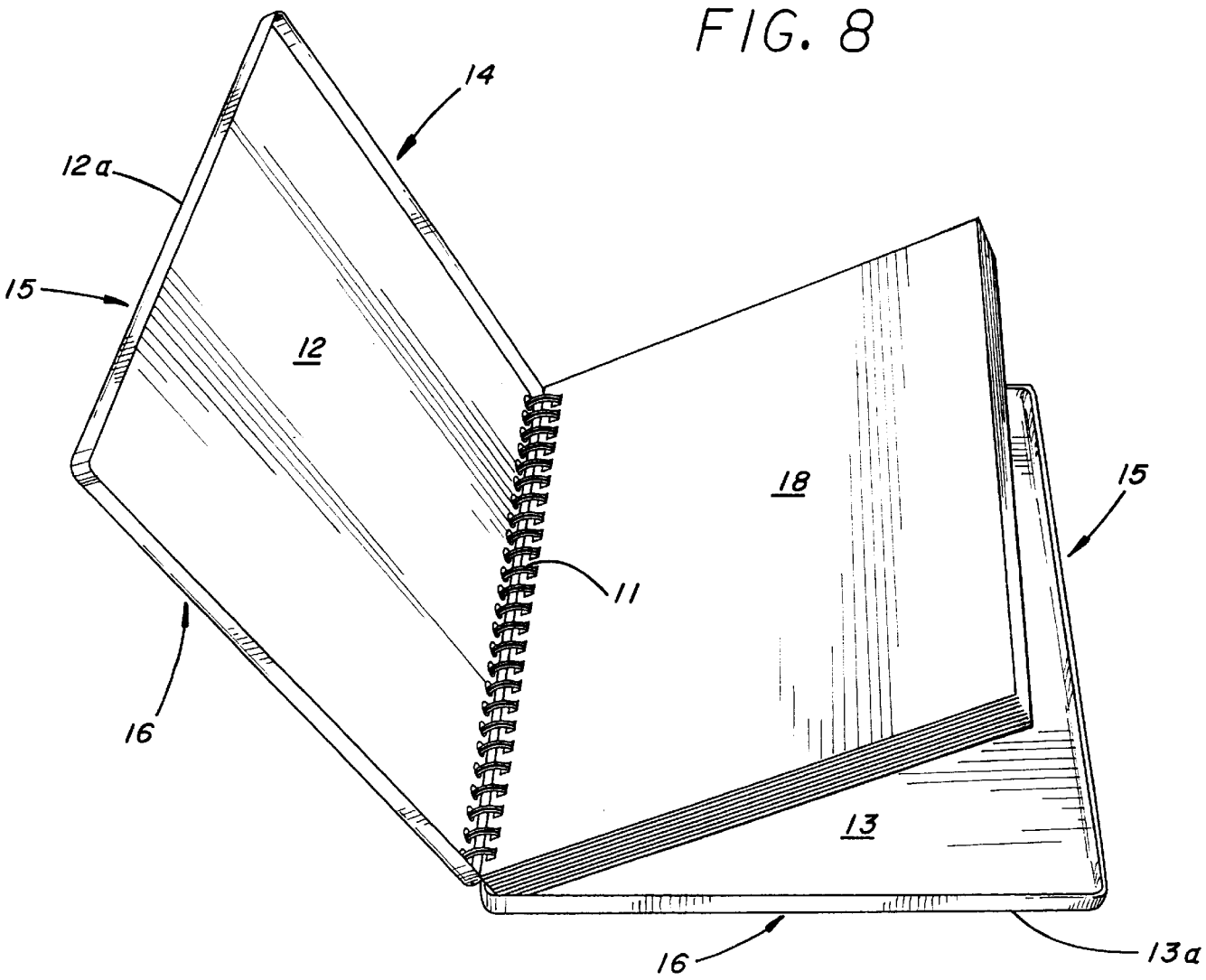
FIG. 8 is a perspective view of the notebook in an open position according to an embodiment of the present invention.

The first and second covers 12, 13 define a first edge 14, a second edge 15, a third edge 16, and a fourth edge 17 of the notebook 10. A binding 11 binds the first cover 12 to the second cover 13 at one of the edges, such as at the fourth edge 17 (FIG. 5). The binding 11 also binds or sandwiches between the covers 12, 13 a plurality of sheets of paper or recording elements 18 at the same one edge, such as the fourth edge 17, as best seen in FIG. 8. In this embodiment, and while other bindings can be used, the binding comprises a spiral wire that extends through a plurality of first apertures 19 in the first cover 12 and that are disposed adjacent the fourth edge 17 (FIGS. 1–2). The wire also extends through a plurality of second apertures 20 in the second cover 13 and that are disposed adjacent the fourth edge 17 (FIG. 3).

A first protective element or lip 12*a* is affixed at and preferably extends along the entirety of the first edge 14, the second edge 15, the third edge 16, and the fourth edge 17 of the first cover 12 (FIGS. 1, 4–7). However, it is also contemplated that the first lip element 12*a* may only extend along one or two or three of the four edges 14, 15, 16, 17. In any event, the first lip element 12*a* has a generally planar configuration that extends substantially perpendicularly away from a first plane in which the first cover 12 lies and towards the second cover 13. Further, the first lip element 12*a* is positioned to interface at least a portion of the edges of the sheets of paper 18 at a substantially perpendicular orientation (FIG. 8). Although it can vary, the height of the first lip element 12*a* is preferably about one-half the total height of the sheets of paper 18 when stacked together. The first lip element 12*a* is constructed of a third rigid or impact resistant material, such as with the first and second rigid materials, so that the lip element 12*a* is prevented from bending or otherwise changing its shape to such an extent that paper within the notebook 10 is damaged. Preferably, the first lip element 12*a* is integrally formed with the first cover 12 to provide ease of manufacturing. Nevertheless, the first lip element 12*a* can be separate from the first cover 12.

Similar to the first protective element 12*a*, a second protective element or lip 13*a* is affixed at and preferably extends along the entirety of the first edge 14, the second edge 15, the third edge 16, and the fourth edge 17 of the second cover 13 (FIGS. 1, 4–7). However, it is likewise contemplated that the second lip element 13*a* may only extend along one or two or three of the four edges 14, 15, 16, 17. The second lip element 13*a* is constructed of a fourth rigid or impact resistant material, such as with the first, second and third rigid materials. Thereby, the lip element 13*a* is prevented from bending or otherwise changing its shape to such an extent that paper within the notebook 10 is damaged Preferably, the second lip element 13*a* is integrally formed with the second cover 13. Nevertheless, the second lip element 13*a* can be separate from the second cover 13. The second lip element 13*a* is preferably configured and dimensioned to match the first lip element 12*a*. Thus, the second lip element 13*a* also has a generally planar configuration that extends substantially perpendicularly away from a second plane in which the second cover 13 lies and towards the first cover 12. So positioned, the second lip element 13*a* lies substantially coplanar to the first lip element 12*a*. The second lip element 13*a* also interfaces and is disposed adjacent the first cover 12 and, specifically, at least a portion of the first lip element 12*a*. The second lip element 13*a* additionally interfaces at least a portion of the edges of the sheets of paper 18 at a substantially perpendicular orientation (FIG. 8). Thereby, the first cover 12, the second cover 13, the first lip element 12*a*, and the second lip element 13*a* form a closed housing within which the sheets of paper 18 are enclosed.

As mentioned above, the first and second lip elements 12*a*, 13*a* can, in another embodiment, extend along less than all of the four edges 14–17. Nevertheless, it is preferred that the lip elements 12, 13*a* extend along at least a majority of the four edges 14–17 or perimeters of the covers 12, 13. As an example, the first lip element 12 may extend only along the second edge 15, while the second lip element extends only along the first edge 14 and the third edge 16. In such embodiment, the height of the first lip element 12*a* would approximate the total height of the sheets of paper 18 stacked together. Likewise, the height of the second lip element 13*a* would approximate the same height. Thus, when the notebook is in a closed position, the second lip element 13*a* would be disposed on either side of the first lip element 12*a*.

As can be appreciate by those skilled in the art, the present invention provides a closed housing within which sheets of paper can be protected. The housing is provided in the absence of means for juxtaposing the first lip element 12*a* to the second lip element 13*a* , such as fasteners. The notebook 10 provided by the present invention is simple in design yet provides protection to the sheets of paper 18 therein. This notebook 10 provides protection for more than just the writing area of pages 18 in the notebook 10. It also protects all of the edges of the sheets of paper 18. Additionally, the notebook 10 protects the pages 18 from impact damage and the like.

It should be understood, of course, that the foregoing relates to preferred embodiments of the invention and that modifications may be made without departing from the spirit and scope of the invention as set forth in the following claims.

What is claimed is:

1. A notebook having a recording element, comprising:

a first cover comprised of a first rigid material;

a second cover comprised of a second rigid material, said second cover interfacing said first cover;

a binding that binds together said first and second covers;

a first lip element that extends about a portion of said first cover, said first lip element comprising a third rigid material and interfacing an edge of said recording element; and a second lip element that extends about a portion of said second cover, said second lip element comprising a fourth rigid material and interfacing said recording element and first cover, p1 whereby said first and second lip elements form a part of a housing to prevent damage to said recording element.

2. The notebook of claim 1, wherein said first, second, third and fourth rigid materials comprise a material selected from the group consisting of plastics and metals.

3. The notebook of claim 1, wherein said binding comprises a spiral shaped wire.

4. The notebook of claim 1, wherein said first lip element extends about an edge of said first cover.

5. The notebook of claim 1, wherein said second lip element extends about an edge of said second cover.

6. The notebook of claim 1, wherein said second lip element interfaces said first lip element.

7. The notebook of claim 1, wherein said second lip element interfaces said edge of said recording element.

8. A notebook having a paper with a paper edge, comprising:

a first cover comprised of a first impact resistant material and having a first edge;

a second cover comprised of a second impact resistant material, said second cover having a second edge and interfacing said first cover;

a binding that binds together said first and second edges;

a first lip element that extends away from a first plane said first cover, said first lip element comprised of a third impact resistant material and interfacing said paper edge; and a second lip element that extends away from a second plane of said second cover, said second lip element comprised of a fourth impact resistant material and interfacing said paper edge and first lip element, whereby said first and second lip elements form a part of a housing that prevent damage to said paper edge.

9. The notebook of claim 8, wherein said first, second, third, and fourth impact resistant materials comprise a metal.

10. The notebook of claim 8, wherein said first lip element is affixed to said first edge.

11. The notebook of claim 8, wherein said first lip element extends substantially perpendicular to said first plane.

12. The notebook of claim 8, wherein said second lip element is affixed to said second edge.

13. The notebook of claim 8, wherein said second lip element extends substantially perpendicular to said second plane.

14. The notebook of claim 8, wherein said first lip element extends about a majority of a perimeter of said first cover.

15. The notebook of claim 8, said second lip element extends about a majority of a perimeter of said second cover.

16. A notebook having a paper with a paper edge, comprising:

a first cover comprised of a first metallic material and having a plurality of first edges;

a second cover comprised of a second metallic material, said second cover having a plurality of second edges and interfacing said first cover;

a binding that binds together one of said first edges to one of said second edges;

a first lip element that extends substantially perpendicular from a first plane said first cover, said first lip element comprised of a third metallic material and interfacing said paper edge at a substantially perpendicular angle; and a second lip element that extends substantially perpendicular from a second plane of said second cover, said second lip element comprised of a fourth metallic material and interfacing said paper edge at a substantially perpendicular angle, whereby said first cover, second cover, first lip element, and second lip element form a housing that encloses and prevents damage to a writing area of said paper and to said paper edge.

17. The notebook of claim 16, further comprising a first magnet fixed to said first cover.

18. The notebook of claim 16, further comprising a second magnet fixed to said second cover and operatively adjacent said first magnet.

19. The notebook of claim 16, wherein said first edges extend about a majority of a perimeter of said first cover.

20. The notebook of claim 19, wherein said first lip element is affixed to and extends over substantially all of said first edges.

21. The notebook of claim 16, wherein said second edges extend about a majority of a perimeter of said second cover.

22. The notebook of claim 21, wherein said second lip element is affixed to and extends over substantially all of said second edges.

23. The notebook of claim 16, wherein said first lip element is disposed substantially coplanar with said second lip element.

* * * * *

UNITED STATES PATENT AND TRADEMARK OFFICE

CERTIFICATE OF CORRECTION

PATENT NO. : 6,203,230 B1
DATED : March 8, 2000
INVENTOR(S) : Yoon S. Whang

It is certified that error appears in the above-identified patent and that said Letters Patent is hereby corrected as shown below:

Title page,
After "References Cited, U.S. PATENT DOCUMENTS" insert:

| | | | |
|---|---|---|---|
| -- 718,827 | 1/1903 | Deydier | -- |
| -- 959,284 | 5/1910 | Andrews et al | -- |
| -- 3,938,831 | 2/1976 | Herman | 281/29 -- |
| -- 5,709,409 | 1/1998 | Engel | 281/15.1 -- |

Signed and Sealed this

Nineteenth Day of March, 2002

*Attest:*

*Attesting Officer*

JAMES E. ROGAN
*Director of the United States Patent and Trademark Office*